US005139068A

United States Patent [19]

Lohausen

[11] Patent Number: 5,139,068

[45] Date of Patent: Aug. 18, 1992

[54] TILT LIMITER FOR AWNINGS

[76] Inventor: Viktor Lohausen, Am Lerchenberg 28, D 7101 Oberheinriet, Fed. Rep. of Germany

[21] Appl. No.: 566,388

[22] PCT Filed: Feb. 17, 1989

[86] PCT No.: PCT/DE89/00092

§ 371 Date: Aug. 27, 1990

§ 102(e) Date: Aug. 27, 1990

[87] PCT Pub. No.: WO89/08175

PCT Pub. Date: Sep. 8, 1989

[30] Foreign Application Priority Data

Mar. 1, 1988 [DE] Fed. Rep. of Germany ..... 3806504

[51] Int. Cl.[5] ..... E04F 10/06

[52] U.S. Cl. ..... 160/66; 160/70

[58] Field of Search ..... 160/66, 45, 70, 79, 160/69, 67

[56] References Cited

FOREIGN PATENT DOCUMENTS 2752872 5/1979 Fed. Rep. of Germany .
8709415 7/1987 Fed. Rep. of Germany .
2335687 12/1975 France .
2443543 12/1979 France .
542337 11/1973 Switzerland .

*Primary Examiner*—Blair M. Johnson
*Attorney, Agent, or Firm*—Sughrue, Mion, Zinn Macpeak & Seas

[57] ABSTRACT

An arrangement of an adjustable tilt limiter with or without recoil lock within a mounting tube (2) for awnings, preferably for ones with tilt adjustment, has the tilt limiter mechanism (6) integrated within the mounting tube (2). A mounting cradle (4) is provided for supporting the tilt limiter which cradle is open on one side and is closed to the rear by a mounting plate (3). Bearing blocks act as pivot supports for an adjusting mechanism (6) for the tilt limiter (11). The mounting tube (2) has sections which join respective sides of the mounting cradle via short connection pieces (7) on the cradle which are telescopically connected to the respective mounting tube sections.

4 Claims, 1 Drawing Sheet

FIG.1
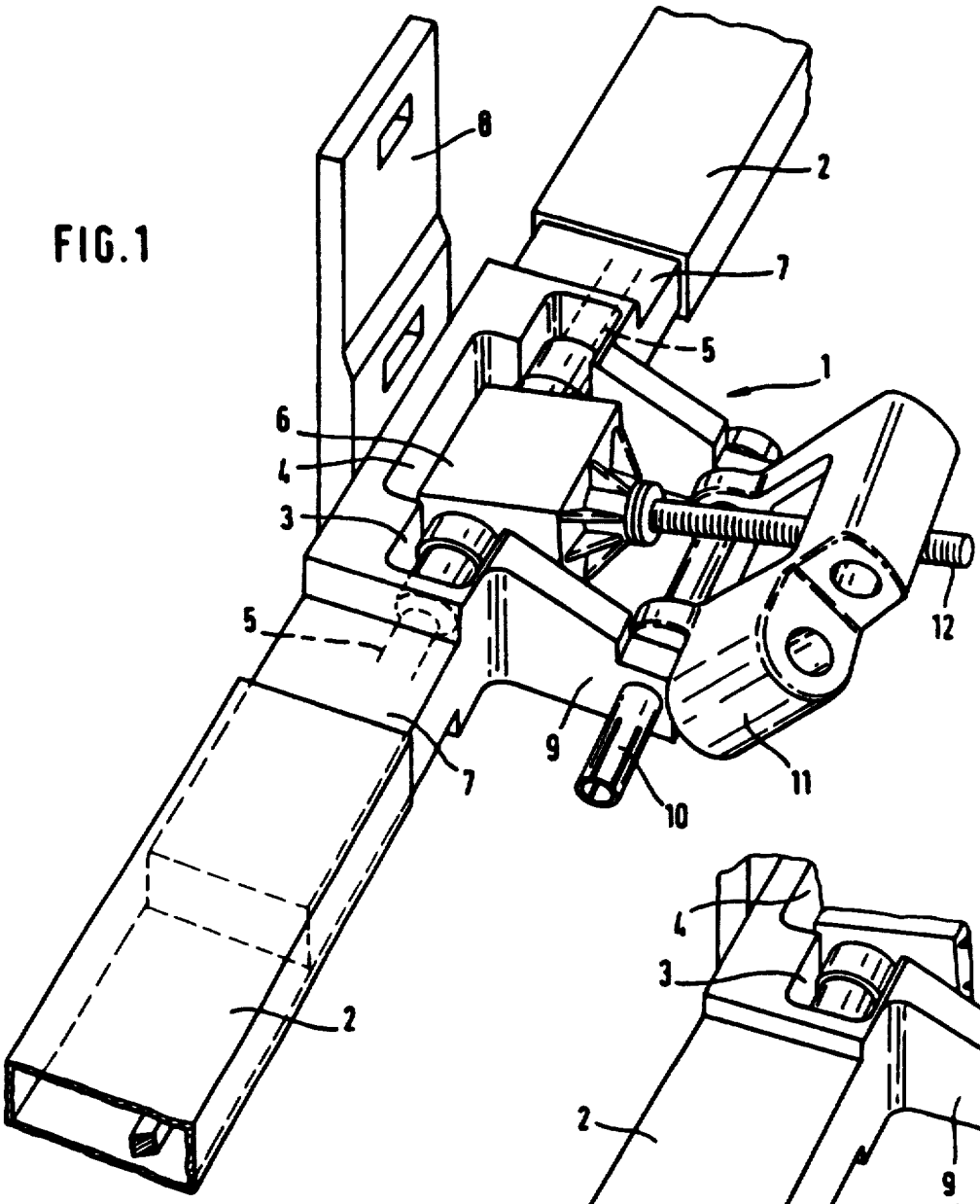
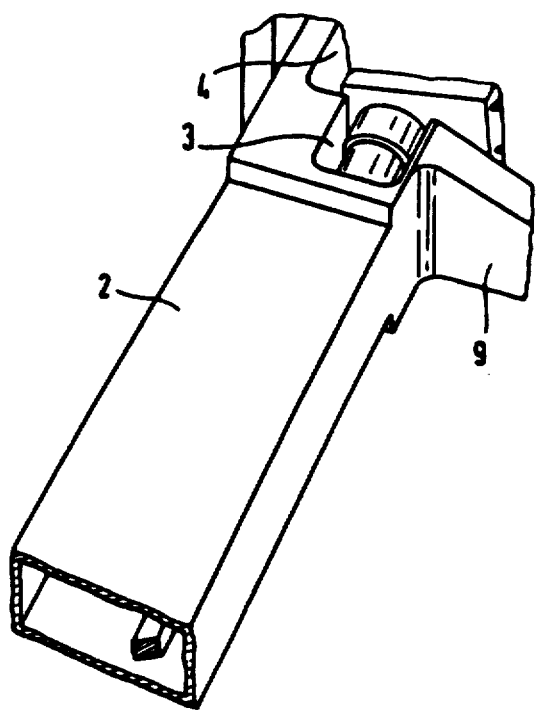
FIG.2

TILT LIMITER FOR AWNINGS

The invention relates to an arrangement of a preferably adjustable tilt limiter with or without recoil lock in conjunction with a mounting tube for awnings.

Such arrangements are known and are located around the mounting tube, on the mounting tube or in front of the mounting tube, for example. On the one hand, reliable securing of a tilt limiter on the mounting tube is not simple and this is mostly not very stable. On the other hand, an arrangement of the tilt limiter mechanism on the mounting tube or encircling it results in an unnecessarily large overall height and overall depth around the latter which it is increasingly attempted to avoid. Furthermore, such arrangements, which often consist of a large number of parts, are also very complex and therefore expensive.

With respect to the state-of-the-art, an articulated awning with an adjusting shaft passing through the support tube is known from DE 28 34 486 C 2, this possessing swivel bearings for the articulated arms located on brackets, whereby the tilt angle of these arms can be adjusted by means of a worm fixed on the adjusting shaft and a worm wheel with internal thread acting in conjunction therewith via a thrust rod passing through the thread and an angle lever arrangement. Here, only the drive for tilt adjustment of the articulated arms is contained in the support tube.

Other arrangements of this type are known, for example, from DE-GM 80 05 351, DE 32 06 963 C 2 and DE 34 47 792 A 1, as well as from DE 34 12 125 C 1. Common to all these arrangements is that they possess a relatively large overall height and overall depth.

The task of the invention is thus to improve the stability of the arrangement of an adjustable tilt limiter in conjunction with a mounting tube, to reduce the overall height and overall depth, to considerably simplify production and thus to make it considerably less expensive and, overall, to reduce the arrangement in all dimensions.

This is achieved by the invention owing to the fact that the tilt limiter mechanism is integrated in the area of the mounting tube and that the arrangement consists of a mounting cradle with bearing block closed to the rear by a mounting plate, whereby the bearing block acts as a pivoting support for an encapsulated adjusting mechanism for the actual tilt limiter, whereby the mounting tube adjoins both sides of the mounting cradle and whereby the bearing block possesses axial bores for the drive spindle of the adjusting mechanism of the tilt limiter.

It is particularly advantageous if the mounting tube adjoining both sides of the mounting cradle is realized as a short connection piece in each case which can be connected telescopically with the actual mounting tube.

It is of quite particular importance and above all economy if the mounting cradle with mounting plate, bearing block, connection pieces for the mounting tube and the holder consist of one piece.

Refer to the other claims for the details of further characteristics.

The invention will now be described in more detail on the basis of a realized example in conjunction with the enclosed figures.

The figures show the following:

FIG. 1 A schematic perspective view of a realized example of the invention and

FIG. 2 A modified design form of the invention.

In FIG. 1, it is possible to see a tilt limiter arrangement 1 for adjustable awnings integrated in the area of the mounting tube. This tilt limiter arrangement is located within the length of a mounting tube 2 and consists of a mounting cradle 4, closed at its rear by a mounting plate 3 and at least partially open at the front and top, with bearing blocks carrying drive shafts 5 mechanism 6 of a tilt limiter 11, whereby the adjusting mechanism is supported so that it has restricted swivelling capacity and is preferably encapsulated. A connection piece 7 adjoins this mounting cradle 4 on at least one side, but preferably on both sides as shown, whereby these are connected telescopically with respective sections of mounting tube 2.

It is possible either to insert the connection piece 7 in the mounting tube 2 as shown or to insert the mounting tube sections in the connection pieces.

A holder 8 is provided on the rear of the mounting plate. Two bearing arms 9 for a tilting spindle 10, about which the adjustable tilt limiter 11 can be swivelled, are located on the front of the mounting cradle 4. The tilt angle of this tilt limiter 11 can be adjusted by means of a screw spindle 12. The tilt limiter is preferably also equipped with a recoil lock.

It is particularly advantageous if the mounting cradle 4 with bearing blocks 5, connection pieces 7, holder 8 and bearing arms 9 closed off by the mounting plate 3 is made of one piece, e.g. cast.

On the other hand, it is also possible to use the design shown in FIG. 2, where the tilt limiter arrangement consists of one piece with the mounting tube 2 on at least one side, whereby the other side can then possess a connection piece.

If a tilt limiter arrangement with two, connection pieces 7 is used, the mounting tube 2 is cut open as shown for the required location of the tilt limiter arrangement and the latter can then be fitted thereto. This arrangement has the additional advantage that individual remaining pieces of mounting tubes can still be used.

However, it must be noted that the mounting cradle may also be closed off at the top by a semi-circular cover for example, which represents the mating piece for the adjusting device 6. Furthermore, it is possible, without deviating from the invention concept, to use a U-shaped mounting bracket instead of a mounting cradle 4 with mounting plate 3. The mounting tube sections or connection pieces 7 may also possess a square or round cross-section instead of a rectangular cross-section. Even a C-shaped mounting rail is covered by the invention concept.

It is therefore possible to see that the demands on which the invention is based are fully satisfied.

I claim:

1. Arrangement of an adjustable tilt limiter mechanism having a tilt adjustment mechanism with or without recoil lock in combination with a mounting tube (2) for awnings, the improvement comprising a mounting cradle mounted between aligned sections of said mounting tube (2), said mounting cradle being open at least on one side thereof and containing lateral bearing blocks for the tilt adjustment mechanism (6), said tilt adjustment mechanism being provided at both sides with a section of enlarged diameter, pivotally fitting onto the bearing blocks, said enlarged diameter sections being provided with a bore and each receiving a drive shaft (5) for driving the tilt adjustment mechanism (6).

2. Arrangement in accordance with claim 1, wherein the mounting cradle (4) has short connection pieces 7 connected telescopically to said sections of the mounting tube, respectively.

3. Arrangement in accordance with claim 2, wherein a holder (8) for the mounting cradle is permanently connected to the rear of the mounting plate and said bearing blocks as well as the connection pieces are comprised of one piece.

4. Arrangement in accordance with claim 3, wherein said mounting cradle, said mounting plate, said bearing blocks, said connection pieces for connection to said mounting tube sections and said holder consist of one piece.

* * * * *